US005992976A

United States Patent [19]

Kimura et al.

[11] Patent Number: 5,992,976

[45] Date of Patent: Nov. 30, 1999

[54] INK-JET PRINTHEAD

[75] Inventors: Hitotoshi Kimura; Hiroshi Arai, both of Nagano, Japan

[73] Assignee: Seiko Epson Corporation, Tokyo, Japan

[21] Appl. No.: 09/013,898

[22] Filed: Jan. 27, 1998

[30] Foreign Application Priority Data

Jan. 27, 1997 [JP] Japan ..... 9-027208
Jan. 19, 1998 [JP] Japan ..... 10-021411

[51] Int. Cl.[6] ..... B41J 2/14; B41J 2/045

[52] U.S. Cl. ..... 347/50; 347/68

[58] Field of Search ..... 347/50, 54, 68, 347/70, 71

[56] References Cited

U.S. PATENT DOCUMENTS 4,695,854 9/1987 Cruz-Uribe ..... 347/70 X
4,698,644 10/1987 Drago et al. ..... 347/50 X
4,703,333 10/1987 Hubbard ..... 347/71 X
4,768,266 9/1988 DeYoung ..... 347/68 X
5,105,209 4/1992 Koto et al. ..... 347/70 X
5,515,086 5/1996 Kakizaki et al. ..... 347/50
5,684,520 11/1997 Morikoshi et al. ..... 347/70
5,880,763 3/1999 Tanaka et al. ..... 347/70

*Primary Examiner*—Sandra Brase
*Attorney, Agent, or Firm*—Sughrue, Mion, Zinn, Macpeak & Seas, PLLC

[57] ABSTRACT

An apparatus which provides a reliable connection of a flexible cable to a transducer unit without damaging the transducer unit. Rounded projections (45) are provided at both ends of the flexible cable (40) when viewed in the direction in which the piezoelectric transducing elements (21) are arrayed, while the rounded projections (45) face a fixing plate (27) onto which the piezoelectric transducing elements (21) are fastened. Each rounded projection has such a height as to prevent the connection terminals of the flexible cable from being inadvertently inserted into the spaces between the adjacent piezoelectric transducing elements of the transducer unit when the flexible cable is located on surface of the transducer unit. At the time of soldering, the connection terminals of the flexible cable (40) are positioned just above the piezoelectric transducing elements (21) of the transducer unit.

24 Claims, 11 Drawing Sheets

40
41
42
43
44
45

40
41
42
43
44
45

43
45
44
44
44
44
44
45
43

INK-JET PRINTHEAD

BACKGROUND OF THE INVENTION

1. Field of the Invention

The present invention relates to an ink-jet printhead in which, by expanding and contracting motions of piezoelectric transducing elements of the longitudinal vibration mode, ink drops are ejected through discharge orifices onto a printing medium to print images, characters and the like thereon. More particularly, the invention relates to a flexible cable for supplying drive signals to a transducer unit having a plural number of piezoelectric transducing elements being arrayed at fixed pitches and fixed onto a fixing plate.

2. Background

Compared with other ink-jet printheads, the printhead which operates in the longitudinal vibration mode is able to operate at a relatively high frequency. In this printhead, a discharge orifice and an elastic plate, constituting parts of a pressure generating chamber, are in fluid communication with a reservoir and form an ink ejecting means. A transducer unit is made up of a plural number of piezoelectric transducing elements of the longitudinal vibration mode, which are arrayed at fixed pitches and fixed on a fixing plate. This type of the piezoelectric transducing element vibrates, or repeats alternating expanding and contracting motions in its longitudinal direction.

A flexible cable is connected to the transducer unit of this type for applying drive signals from an external drive circuit to the piezoelectric transducing elements of the transducer unit. A conventional connection of the flexible cable to the transducer unit is as shown in FIG. 11. Connection patterns A are formed on and along the leading end of a flexible cable B, while being arrayed therealong at a pitch corresponding to the pitch of the transducing element array (FIG. 11(*a*)). To connect the flexible cable B to a transducer unit C, the connection patterns A of the flexible cable B, respectively, are aligned with and bonded, by soldering, to the connection terminals E of piezoelectric transducing elements D of the transducer unit C, respectively (FIG. 11(*b*)).

Specifically, to connect the flexible cable B to the transducer unit C, the connection patterns A of the flexible cable B are vertically roughly aligned with the connection terminals E of the piezoelectric transducing elements D, respectively. The operator, while observing by, for example, a magnifier, slides the flexible cable B above and along the surfaces of the piezoelectric transducing elements D and exactly aligns the connection patterns A respectively at the connection terminals E, and solders the former to the latter.

To secure an easy connection, solder layers are formed on the connection patterns A while being slightly raised from the surface of the flexible cable B. To prevent the shortcircuiting by the molten solder, the width of the connection patterns A 15 shorter than that of the width of the piezoelectric transducing elements D. When aligning the connection patterns A with the connection terminals E of the piezoelectric transducing elements D, the connection patterns A may be positioned in the space between the adjacent piezoelectric transducing elements D as shown in FIG. 11(*c*). In this state, if the flexible cable B is moved with respect to the transducer unit C for positioning, the connection patterns A of the flexible cable B forcibly hit the edges of the piezoelectric transducing elements D to possibly damage the latter. In an extreme case, the piezoelectric transducing elements D are broken at the edges to reduce the connection areas thereof, creating poor contact problem.

Accordingly, an object of the present invention is to provide a flexible cable in use with the transducer unit of the longitudinal vibration mode, the flexible cable being reliably connected to the transducer unit without damaging the transducer unit.

SUMMARY OF THE INVENTION

To solve the above problems, there is provided an ink-jet printhead which includes 1) a passage unit of a multi-layered structure consisting of a nozzle plate with discharge orifices formed therein, a passage forming plate including pressure generating chambers and a reservoir, both being formed therein, and an elastic plate, 2) a transducer unit having a plural number of piezoelectric transducing elements of the longitudinal vibration mode being fastened onto a fixing plate while being arrayed thereon at a fixed pitch, and 3) a flexible cable for supplying electrical signals to the piezoelectric transducing elements. The ink-jet printhead is improved such that rounded projections are provided at both ends of the flexible cable when viewed in the direction in which the piezoelectric transducing elements are arrayed, each rounded projection having such a height as to prevent the connection terminals of the flexible cable from being positioned in the spaces between the adjacent piezoelectric transducing elements of the transducer unit when the flexible cable is located on surface of the transducer unit.

DETAILED DESCRIPTION OF THE INVENTION

The preferred embodiments of the present invention will be described in detail with reference to the accompanying drawings.

Figure 1:
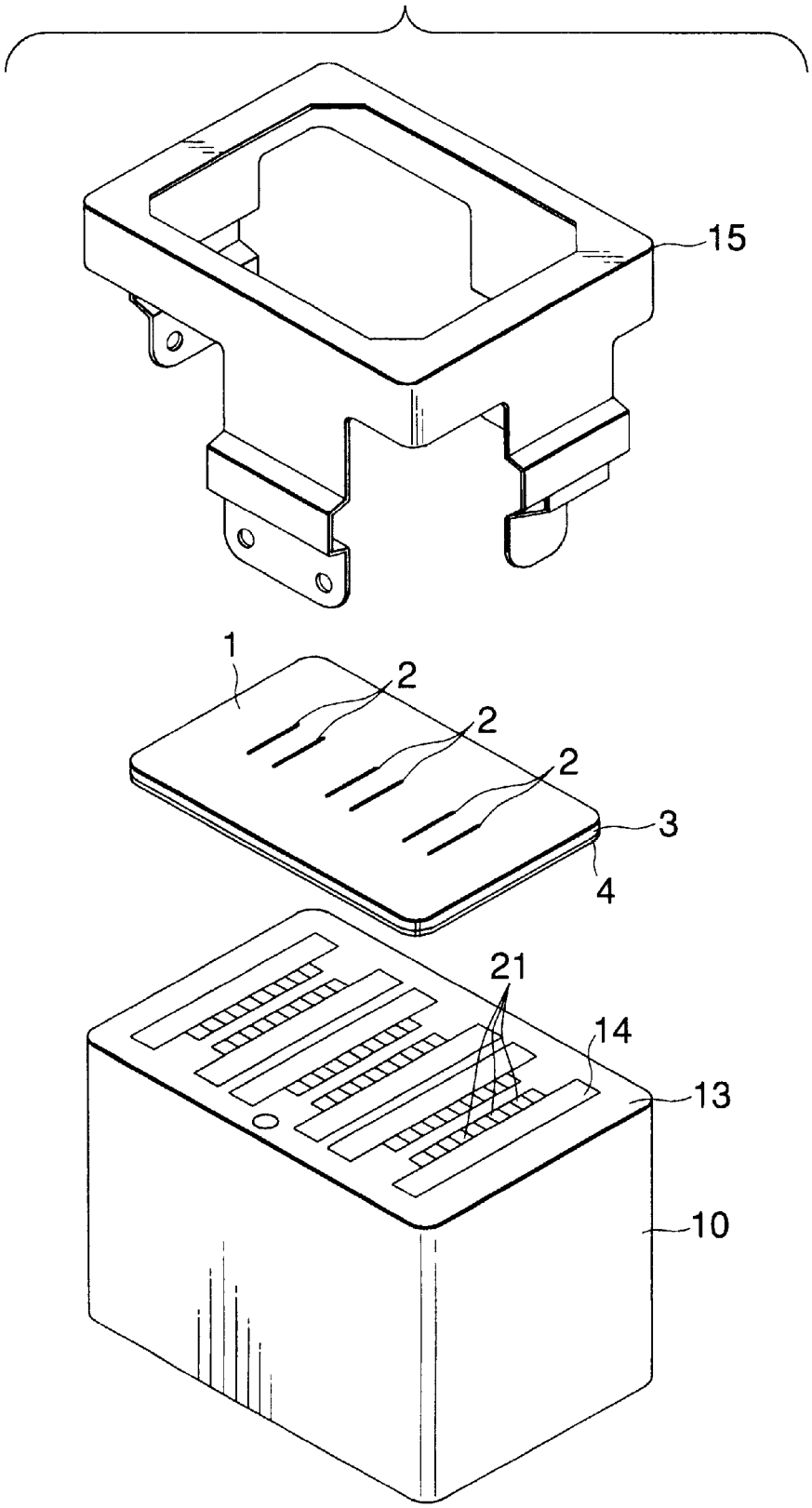
FIG. 1 is an exploded view showing an ink-jet printhead which is an embodiment of the present invention.
Figure 2:
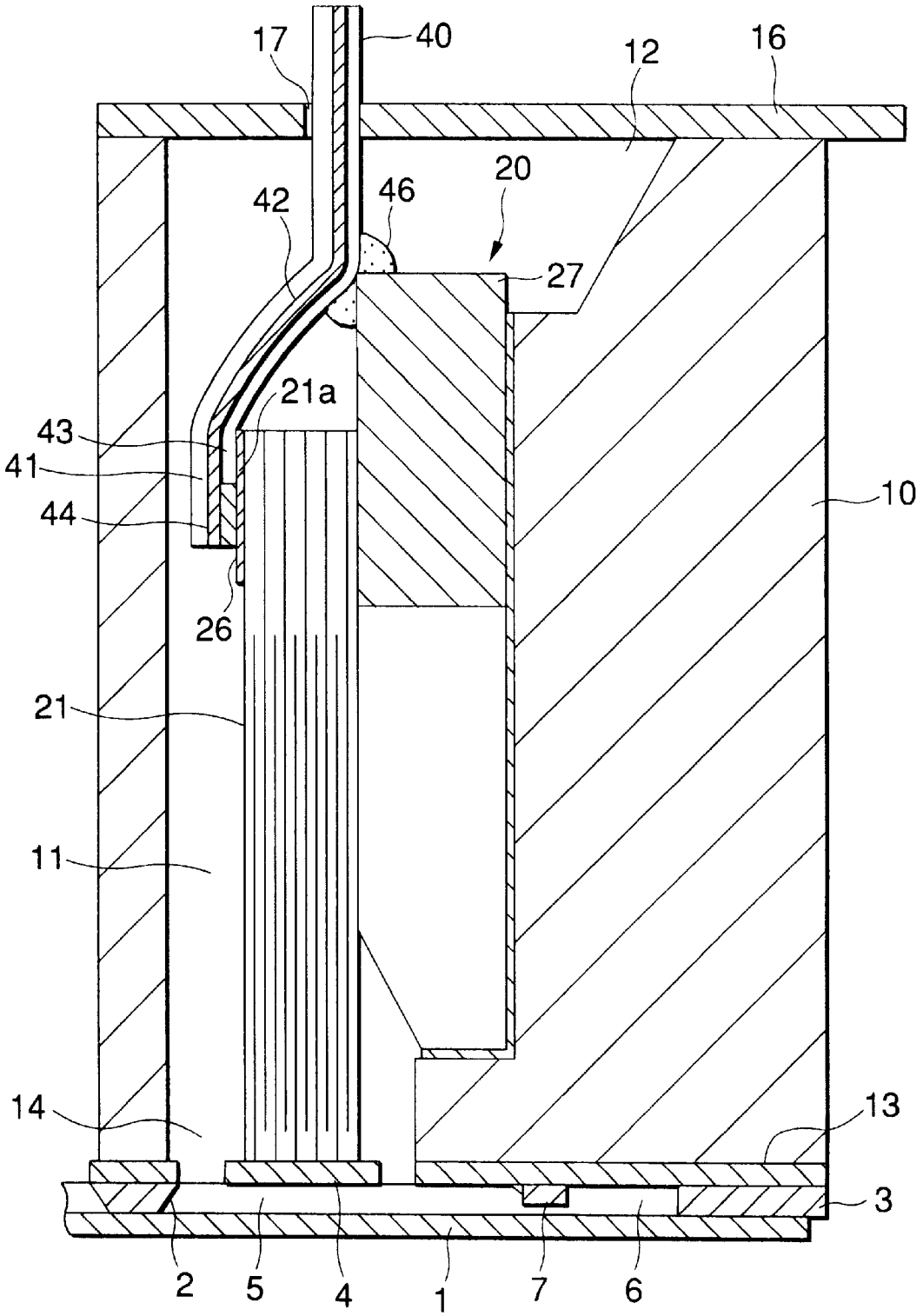
FIG. 2 is a sectional view showing the structure of the printhead of FIG. 1.

FIGS. 1 and 2 show an embodiment of an ink-jet printhead incorporating therein a flexible cable constructed according to the present invention. In the figures, reference numeral 1 is a nozzle plate and numeral 2 is a discharge orifice. A number of discharge orifices 2 are formed in the nozzle plate 1 while being arrayed at predetermined pitches that provide 180 DPI, for example.

Numeral 3 is an ink passage forming plate located between the nozzle plate 1 and elastic plates 4 (discussed below). Pressure generating chambers 5 associated with the discharge orifices 2, a reservoir 6, and through holes connecting them are formed in the ink passage forming plate 3.

The elastic plates 4 are each fastened onto the ink passage forming plate 3 to partially define the pressure generating chambers 5, while being opposed to the nozzle plate 1 with respect to the ink passage forming plate 3. The tips of the piezoelectric transducing elements 21 contained in a transducer unit 20 (discussed below) are abutted against the elastic plates 4, respectively. In operation, vibration associated with the alternating expanding and contracting motions of each piezoelectric transducing element 21 is transferred to the related elastic plate 4, which in turn enlarges and reduces the volume of the related pressure generating chamber 5.

Figure 3A:
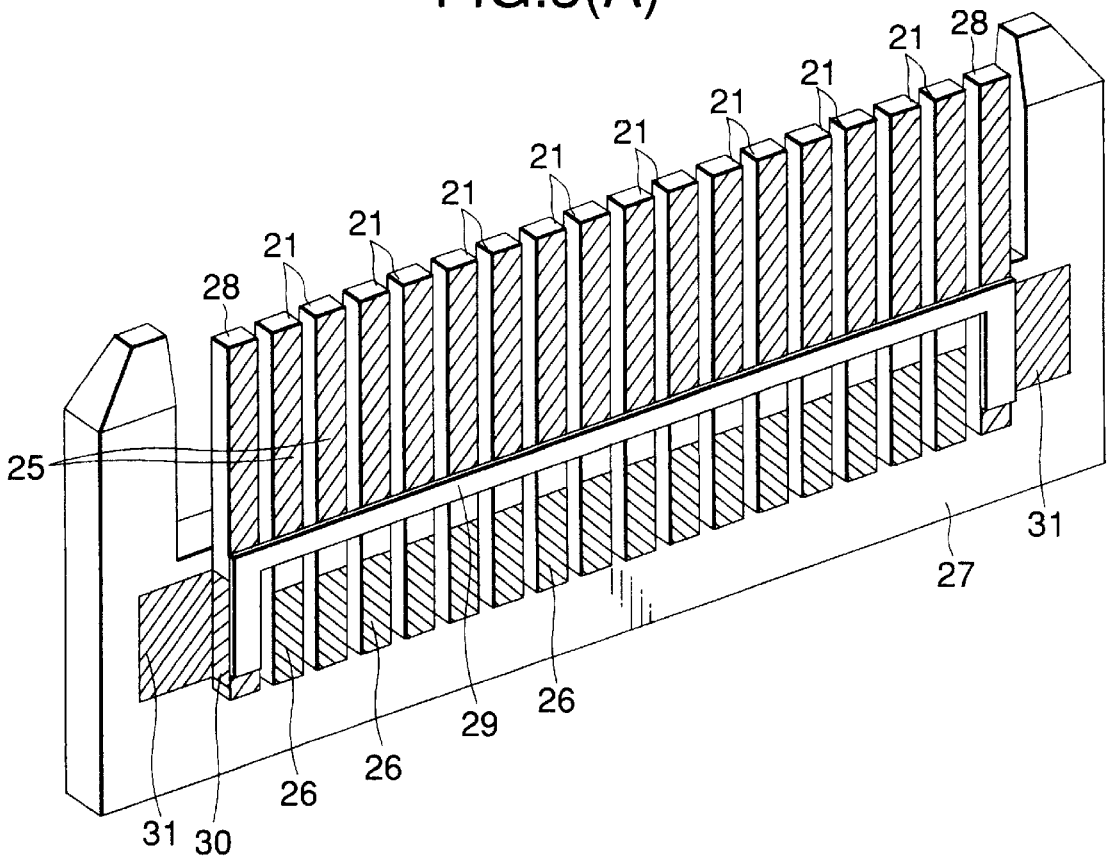
FIGS. 3(*a*) and 3(*b*) are a perspective view and a cross sectional view showing an example of a transducer unit.
Figure 3B:
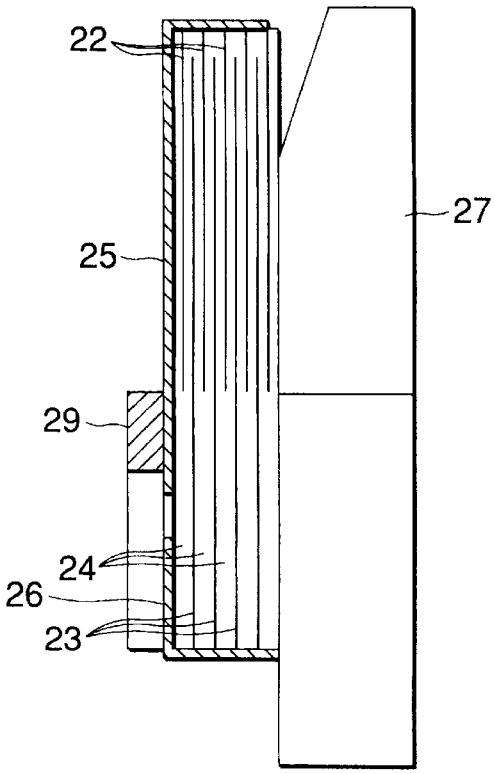

An example of the transducer unit 20 is illustrated in Figs. 3(*a*) and 3(*b*). In the figures, reference numeral 21 is a piezoelectric transducing element; 22 and 23 are electrodes; 24 is a piezoelectric member; 25 is a common electrode; 26 is a segment electrode; and 27 is a fixing plate. As shown, the electrodes 22 and 23 are alternately arranged in an interlacing fashion and the gaps formed thereamong are filled with the piezoelectric material 24. At one end of the electrode/piezoelectric material assembly, the electrodes 22 are extended outward beyond the electrodes 23, while at the other end thereof, the electrodes 23 are extended outward beyond the electrodes 22. The tips of the extended part of electrodes 22 are connected to the common electrode 25, while the tips of the extended part of the electrodes 23 are connected to the segment electrode 26. A plural number of electrode/piezoelectric material assemblies each thus constructed are arrayed at fixed pitches and fastened onto the fixing plate 27.

Dummy transducing elements 29 are located on both side of the linear array of the piezoelectric transducing elements 21. A connection member 29 made of conductive material is fastened to the dummy transducing elements 28 thus arrayed. Conductive patterns 30 are formed on the dummy transducing elements 28. Similarly, connection patterns 31 are formed on the fixing plate 27. The common electrodes 25 of the piezoelectric transducing elements 21 are connected together to the connection member 29. The common electrodes 25 are connected to the connection patterns 31 through the connection member 29 and the conductive patterns 30.

The independent segment electrodes 26 of the piezoelectric transducing elements 21, which are formed on the lower end surfaces of the piezoelectric transducing elements, are exposed to be connected to the flexible cable 40.

Figure 4:
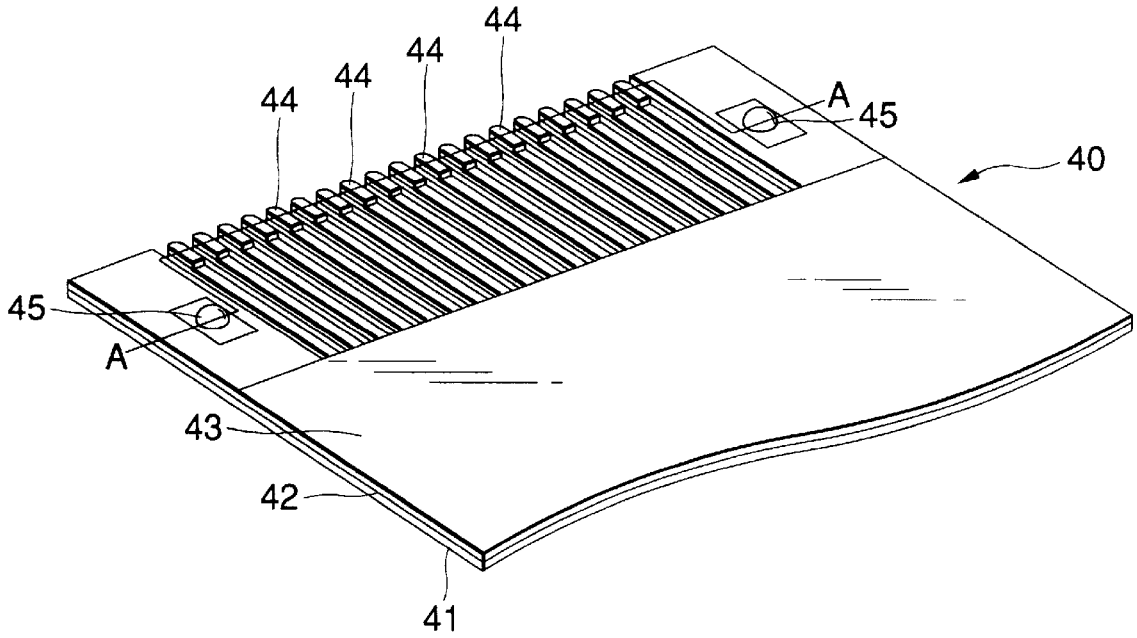
FIG. 4 is a perspective view showing a specific example of a flexible cable constructed according to the present invention.
Figures 5A, 5B, 5C:
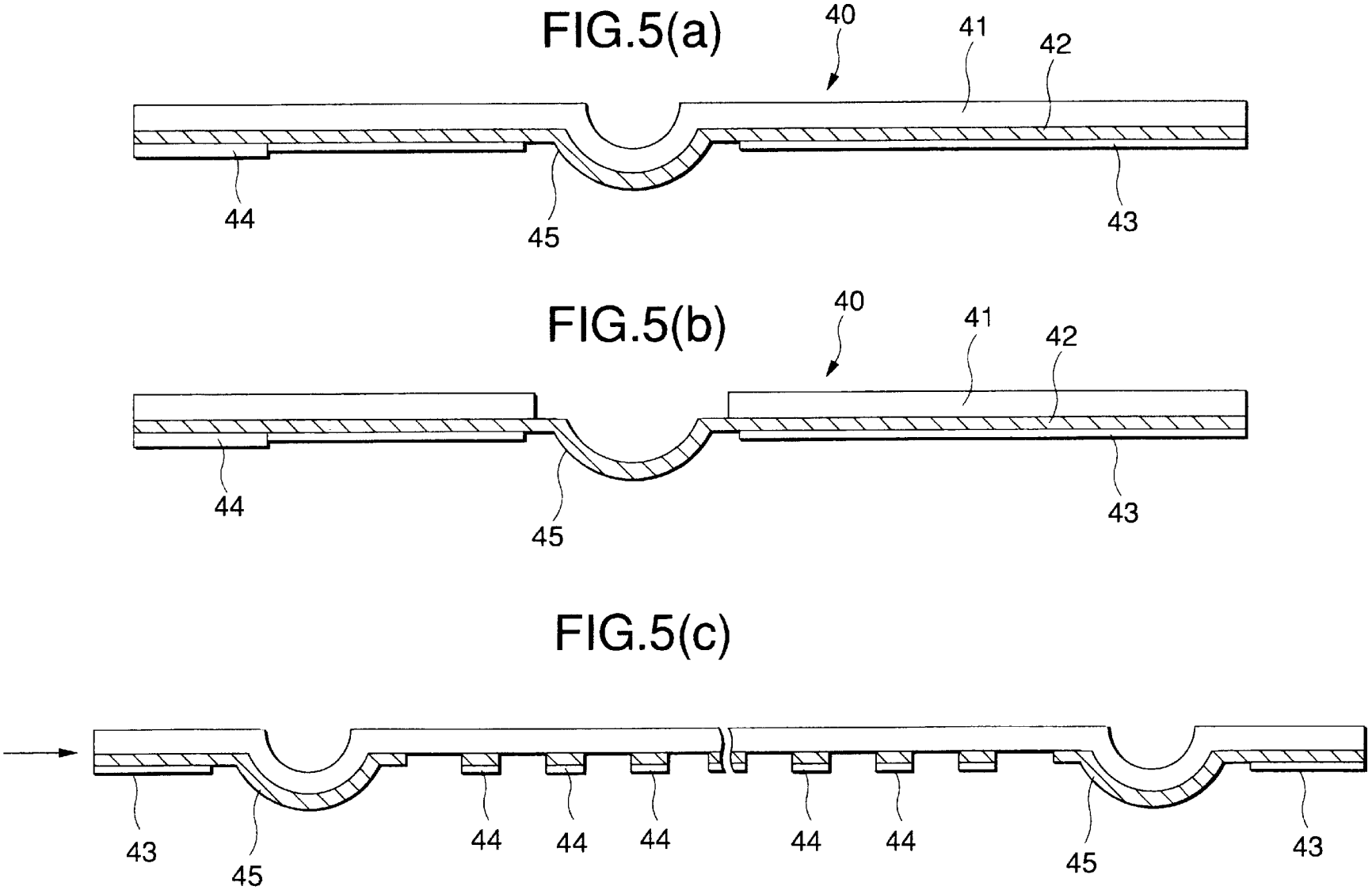
FIGS. 5(*a*) and 5(*b*) are cross sectional views taken along line A—A in FIG. 4, and FIG. 5(*c*) is a front view showing the flexible cable shown in FIG. 4.

Returning to FIGS. 1 and 2, numeral 10 designates a housing shaped as a box-like body having a chamber 11 for accommodating the transducer unit 20 therein. The housing 10 may be formed by injection molding high polymer material. The upper end of the housing 10 has an opening 12 through which the transducer unit 20 is inserted into the housing. The lower end of the housing includes a fixing part 13 and a window 14 which is flush with the fixing part 13. Elastic plates 4, the ink passage forming plate 3 and the nozzle plate 1 are layered on the fixing part 13 of the housing 10. An example of the flexible cable 40 that is essential to the invention is illustrated in FIGS. 4 and 5. The flexible cable 40 is formed with a base layer 41, a conductive layer 42 formed on the base layer, and a cover coat layer 43 covering the surface of the conductive layer 42. The base layer 41 is a heat-resistant, electrically insulating film made of polyamide. The conductive layer 42 is etched to form patterns suitable for supplying signals to the piezoelectric transducing elements 21. Connection terminals 44 are respectively formed on the tops of the patterns while being arrayed at the pitches corresponding to the pitches of the segment electrodes 26 of the piezoelectric transducing elements. 21. Preferably, the width of each connection terminal 44 is selected to be slightly narrower than that of each segment electrode 26. To give an example, when the width of the segment electrode 26 is 60 to 80 $\mu$m, the width of the connection terminal 44 is about 50 $\mu$m. The cover coat layer 43 is extended over the surface of the conductive layer 42 up to a position thereon located slightly closer to the fore end of each piezoelectric transducing element 21 than the rear end 21*a* thereof when the flexible cable 40 is connected to the transducer unit 20.

The cover coat layer 43 is removed from the regions near both sides and the fore end of the flexible cable 40, which will face the connection patterns 31 of the common electrode 25 of the fixing plate 27 when the flexible cable 40 is aligned with and connected to the transducer unit 20, and the base layer 41 and the conductive layer 42 are both embossed (FIG. 5(*a*)) to form rounded projections 45 at those regions. Alternatively, the cover coat layer 43 and the base layer 41 are removed from the same regions of the flexible cable 40, and only the conductive layer 42 is embossed (FIG. 5(*b*)) to form rounded projections 45 in the regions. The rounded projections 45 each such a height as to prevent the connection terminals 44 of the flexible cable 40 from being positioned into the spaces between the adjacent piezoelectric transducing elements 21 of the transducer unit 20 when the flexible cable is located on the surface of the transducer unit. Solder layers are formed on the outer surfaces of the rounded projections 45.

Figure 6:
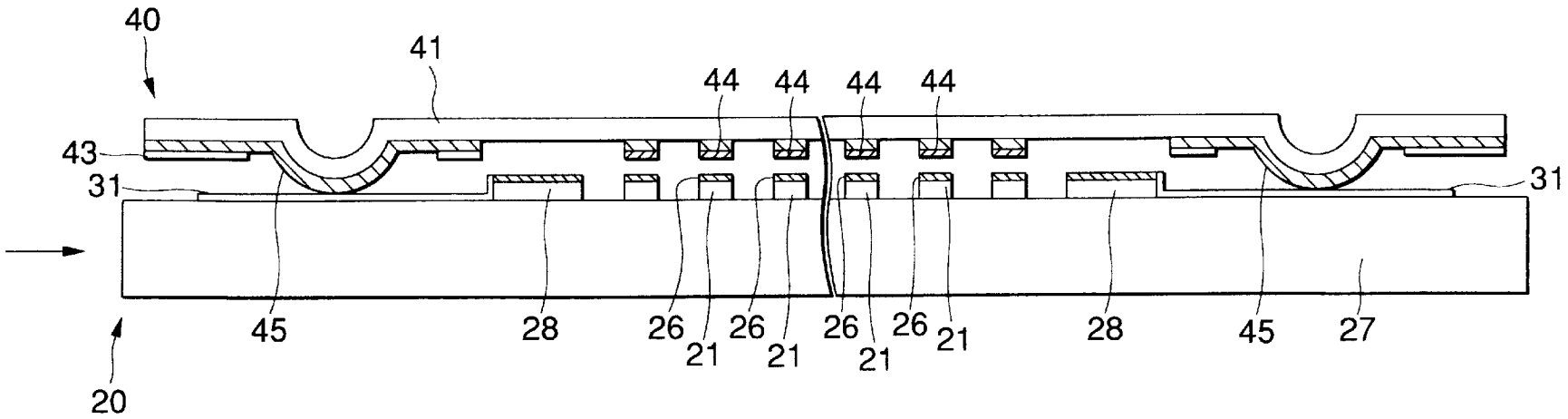
FIG. 6 is a diagram showing a state of the structure of the printhead when the connection terminals of the flexible cable are vertically aligned with the segment electrodes of the piezoelectric transducing elements.

To couple the flexible cable 40 with the transducer unit 20, the transducer unit 20 is fastened to a proper tool in a state that the segment electrodes 26 thereof are directed upward, and the flexible cable 40 is applied to the transducer unit 20 in a state the connection terminals 44 thereof is directed downward. In this case as shown in FIG. 6, the rounded projections 45, which are located near both sides and the fore end of the flexible cable 40, are positioned on the fixing plate 27, and the connection terminals 44 of the flexible cable 40 are located high enough to prevent the connection terminals per se from being inserted into the spaces between the adjacent piezoelectric transducing elements 21 of the transducer unit.

In this state, the flexible cable 40, while not being bent, is moved so that the connection terminals 44 of the cable are vertically and exactly aligned with the segment electrodes 26 of the transducer unit 20, respectively. The connection terminals 44 of the flexible cable 40 are positioned just above the piezoelectric transducing elements 21 of the transducer unit 20. Therefore, even though the width of each connection terminal 44 is shorter than the width of the space between the adjacent piezoelectric transducing elements 21, the flexible cable 40 is smoothly moved since the connection terminals 44 are not inserted into the spaces, and the connection terminals 44 of the flexible cable 40 do not hit the edges of the piezoelectric transducing elements 21. For this reason, there is no chance that the piezoelectric transducing elements 21 are damaged through the movement of the flexible cable 40.

After the connection terminals 44 of the flexible cable 40 are exactly aligned with the piezoelectric transducing elements 21 of the transducer unit 20, respectively, a proper heating tool is applied to the base layer 41 of the flexible cable 40, and heats it under a pressure. Then the solder layers on the connection terminals 44, rounded projections 45 and the connection patterns 31 are molten, so that the segment electrodes 26 are bonded to the connection terminals. 44 of the flexible cable 40 while at the same time the rounded projections 45 of the flexible cable 40 are bonded to the connection patterns 31 of the fixing plate 27.

The rounded projections 45 of the flexible cable 40 are forcibly pressed against the connection patterns 31 of the fixing plate 27 by the pressure applied at the time of soldering, as compared to a case where the flexible cable 40, not having the rounded projections 45, is pressed against the connection patterns 31. Therefore, the flexible cable 40 is reliably soldered at both the sides to the fixing plate 27. Hence, it is difficult for the cable to be peeled off the fixing plate even when external force is applied thereto.

The transducer unit 20 thus connected to the flexible cable 40 is inserted into the housing 10, and connected to, for example, a circuit board 16 having a window 17 formed therein. At this time, stress is exerted on the flexible cable 40. However, no cracks are formed in the conductive layer 42 of the flexible cable 40 since the fore end of the flexible cable 40 is firmly bonded to the fixing plate 27 by adhesive, and the regions on the flexible cable 40 corresponding to the rear ends 21*a* of the piezoelectric transducing elements 21 are coated with the cover coat layer 43. In the figure, numeral 15 designates a frame serving also as-shielding means.

Figure 7:
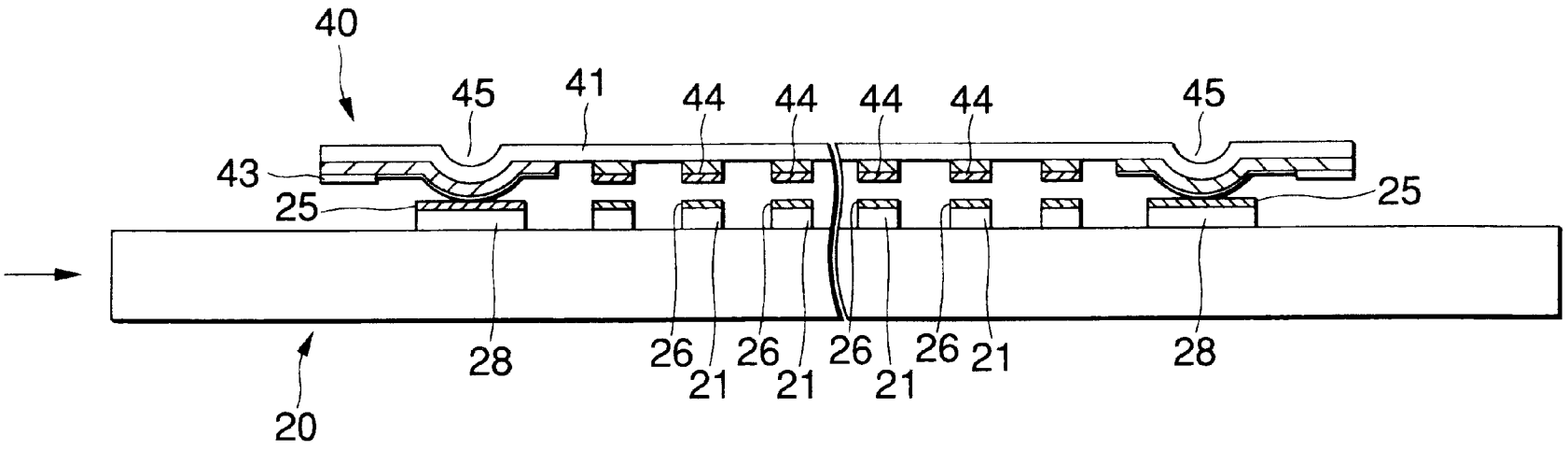
FIG. 7 is a diagram showing a state of the structure of an ink-jet printhead as another embodiment of the invention when the connection terminals of the flexible cable are vertically aligned with the segment electrodes of the piezoelectric transducing elements.

FIG. 7 is a diagram showing a state of the structure of the printhead when the connection terminals of the flexible cable are vertically aligned with the segment electrodes of the piezoelectric transducing elements. The cover coat layer 43 is removed from the regions on the flexible cable 40, which correspond to the dummy transducing elements 28 when the flexible cable 40 is aligned with and connected to the transducer unit 20, and the base layer 41 and the conductive layer 42 are both embossed (FIG. 5(*a*)) to form rounded projections 45 at those regions. Alternatively, the cover coat layer 43 and the base layer 41 are removed from the same regions of the flexible cable 40, and only the conductive layer 42 is embossed (FIG. 5(*b*)) to form rounded projections 45 in the regions. The rounded projections 45 have each such a height as to prevent the connection terminals 44 of the flexible cable 40 from being positioned in the spaces between the adjacent piezoelectric transducing elements 21 of the transducer unit 20 when the flexible cable is located on surface of the transducer unit. Solder layers are formed on the outer surfaces of the rounded projections 45.

To couple the flexible cable 40 with the transducer unit 20, the transducer unit 20 is fastened to a proper tool in a state that the segment electrodes 26 thereof are directed upward, and the flexible cable 40 is applied to the transducer unit 20 in a state that the connection terminals 44 thereof is directed downward. In this case, as shown in FIG. 7, the rounded projections 45 of the flexible cable 40 are brought into contact with the dummy transducing elements 28, and the connection terminals 44 of the flexible cable 40 are located slightly above the surfaces of the piezoelectric transducing elements 21, to thereby prevent the connection terminals from being inserted into the spaces between the adjacent piezoelectric transducing elements 21 of the transducer unit.

In this state, the flexible cable 40, while not being bent, is moved so that the connection terminals 44 of the cable are vertically and exactly aligned with the segment electrodes 26 of the transducer unit 20, respectively. The connection terminals 44 of the flexible cable 40 are positioned just above the piezoelectric transducing elements 21 of the transducer unit 20. Therefore, even though the width of each connection terminal 44 is shorter than the width of the space between the adjacent piezoelectric transducing elements 21, the flexible cable 40 is smoothly moved since the connection terminals 44 are not positioned into the spaces, and the connection terminals 44 of the flexible cable 40 do not hit the edges of the piezoelectric transducing elements 21. For this reason, there is no chance that the piezoelectric transducing elements 21 are damaged through the movement of the flexible cable 40.

After the connection terminals 44 of the flexible cable 40 are exactly aligned with the piezoelectric transducing elements 21 of the transducer unit 20, respectively, a proper heating tool is applied to the base layer 41 of the flexible cable 40, and heats it under pressure. Then, the solder layers on the connection terminals 44 and rounded projections 45 are molten, so that the segment electrodes 26 are bonded to the connection terminals 44 of the flexible cable 40 while at the same time the rounded projections 45 of the flexible cable 40 are bonded to the common electrodes 25 of the dummy transducing elements 28.

Thus, according to the invention, the rounded projections 45 of the flexible cable 40 are forcibly pressed against the common electrodes 25 of the dummy transducing elements 28 or the segment electrode 26 by the pressure applied at the time of soldering because of the rounded projections 45 are raised from the remaining portion of the cable. Therefore, the flexible cable 40 is reliably soldered at both the sides to the fixing plate 27. Hence it is difficult for the cable to be inadvertently peeled off the fixing plate even when external force is applied thereto.

Figure 8A:
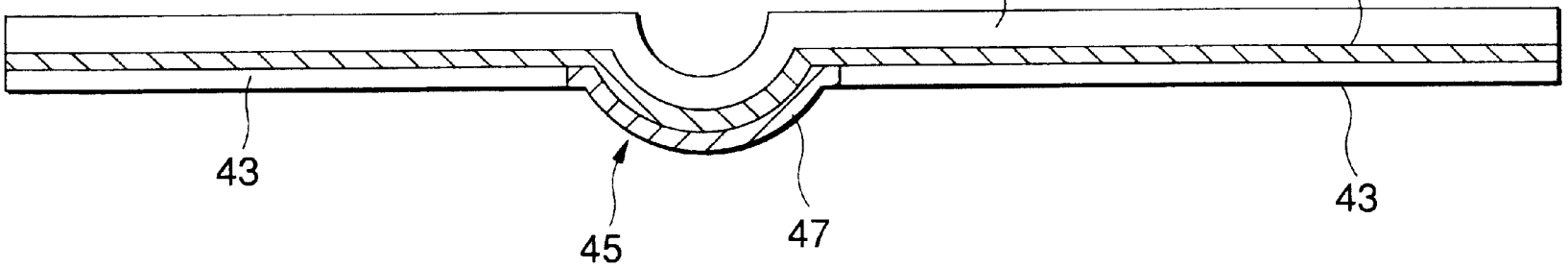
FIGS. 8(*a*) and 8(*b*) are sectional views showing other examples of rounded projections of the flexible cable formed by embossing the cable, which are constructed according to the present invention.
Figure 8B:
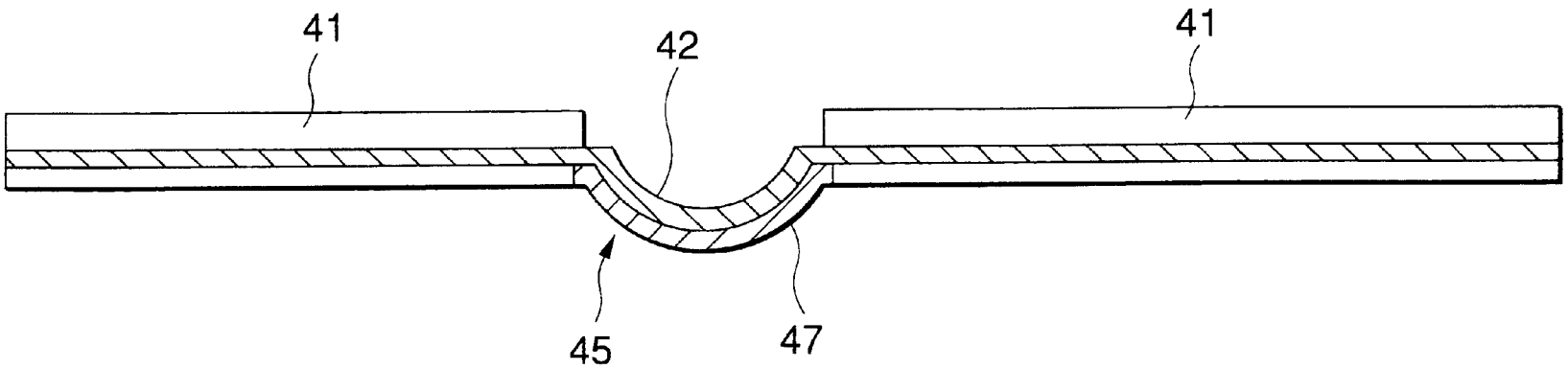

It is noted that in the present embodiment of FIG. 7, there is no need for using the conductive patterns 30 and the connection patterns 31, both formed on the transducer unit 20, which are essential to the first embodiment (FIG. 3(*a*)). FIG. 8 shows other examples of the rounded projections 45 of the flexible cable formed by embossing the cable, which are constructed according to the present invention. In the example shown in FIG. 8(*a*), the cover coat layer 43 is removed from the regions on the flexible cable 40 which are to be embossed, and solder layers 47 are formed on the same regions. The thickness of the solder layer 47 is comparable with that of the cover coat layer 43. In the example shown in FIG. 8(*b*), the base layer 41 and the cover coat layer 43 are removed from the regions on the flexible cable 40 which are to be embossed, and solder layers 47 are formed on the same regions. The thickness of the solder layer 47 is comparable with that of the cover coat layer 43.

The solder layer 47 may be formed before or after the flexible cable 40 is embossed.

Figure 9:
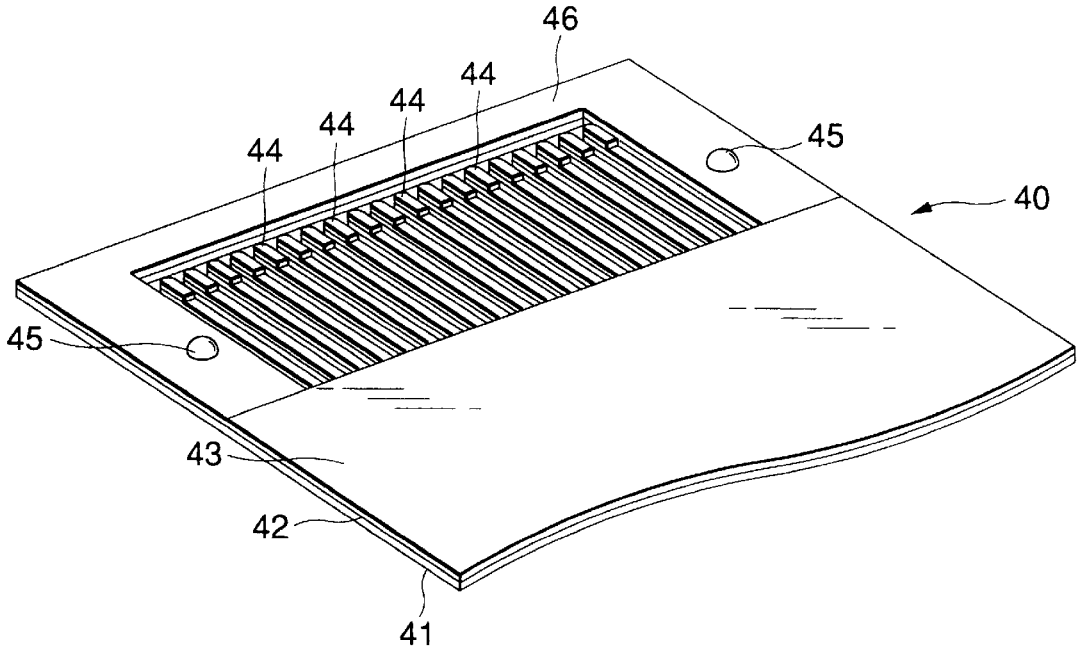
FIG. 9 is a perspective view showing another example of the flexible cable, constructed according to the present invention.

FIG. 9 is a perspective view showing another example of the flexible cable, constructed according to the present invention. In this instance, a connection pattern 46 is formed, in the form of a solder layer, on the fore end region of the flexible cable 40. The connection pattern 46 is configured like the connection member 29 of the transducer unit 20. To connect the flexible cable 40 thus constructed to the transducer unit 20, the common electrode 25 of the piezoelectric transducing elements 21 is heated by a suitable heating tool under a pressure. Then, the connection pattern 46 and the remaining connection portions on the flexible cable 40 are molten to connect the common electrode 25 of the piezoelectric transducing elements 21 and the segment electrodes 26 of the dummy transducing elements 28 to the connection pattern 46 of the flexible cable 40. In this instance, there is no need of forming the connection member 29 on the transducer unit 20.

In the above-mentioned embodiments, solder is used for the establishing of conductive connections. This may be substituted by using anisotropic conductive material or conductive adhesion.

Figure 10A:
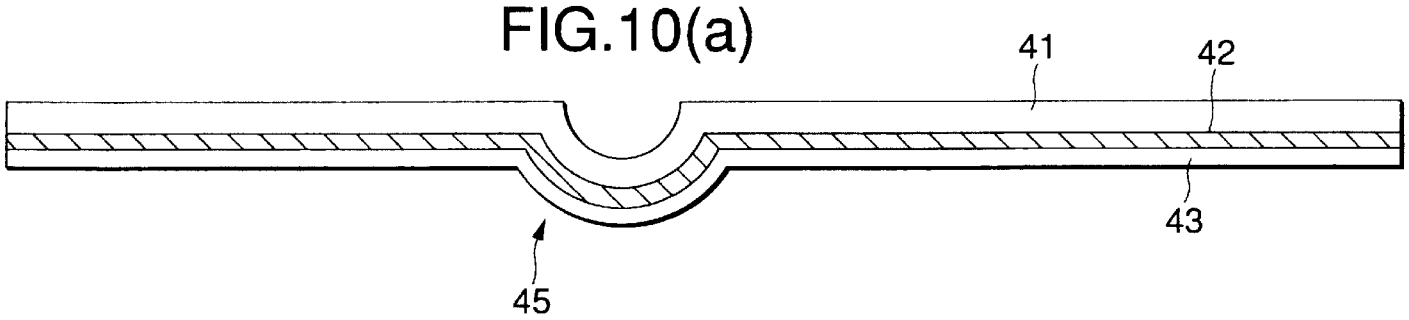
FIGS. 10(*a*)–10(*c*) are sectional views showing additional examples of rounded projections of the flexible cable formed by embossing the cable, which are constructed according to the present invention.
Figure 10B:
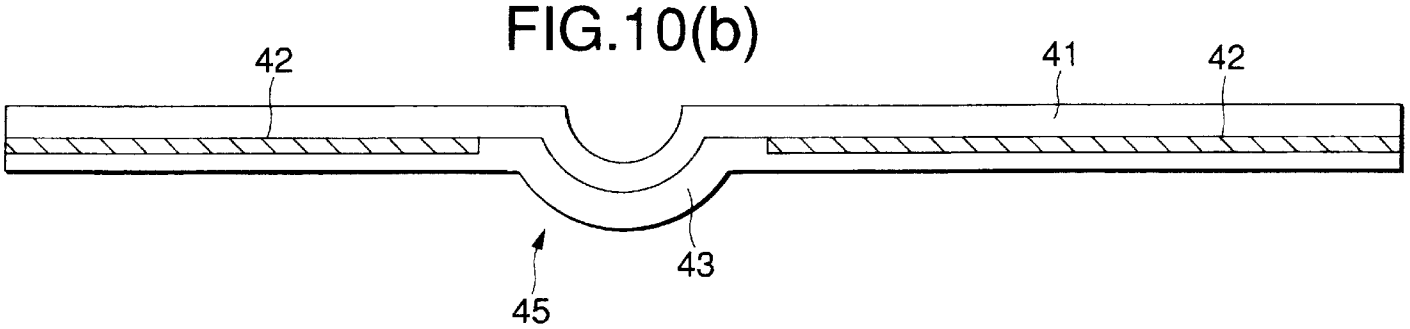
Figure 10C:
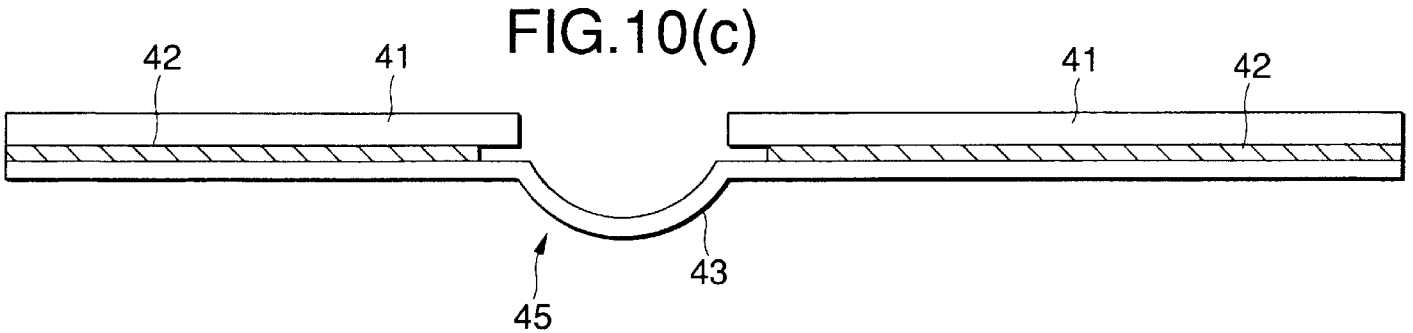
Figure 11A:
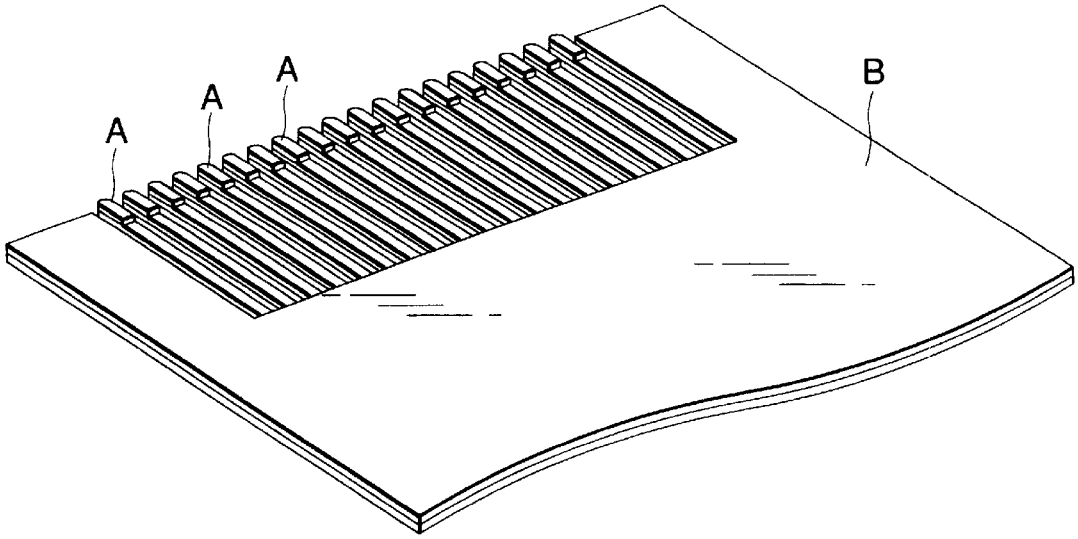
FIG. 11(*a*) is a perspective view showing a conventional flexible cable, FIG. 11(*b*) is a sectional view showing the structure of the printhead when the flexible cable is exactly aligned with and connected to the transducer unit and FIG. 11(*c*) is a sectional view showing the structure of the printhead when the flexible cable is misaligned with the transducer unit.
Figure 11B:
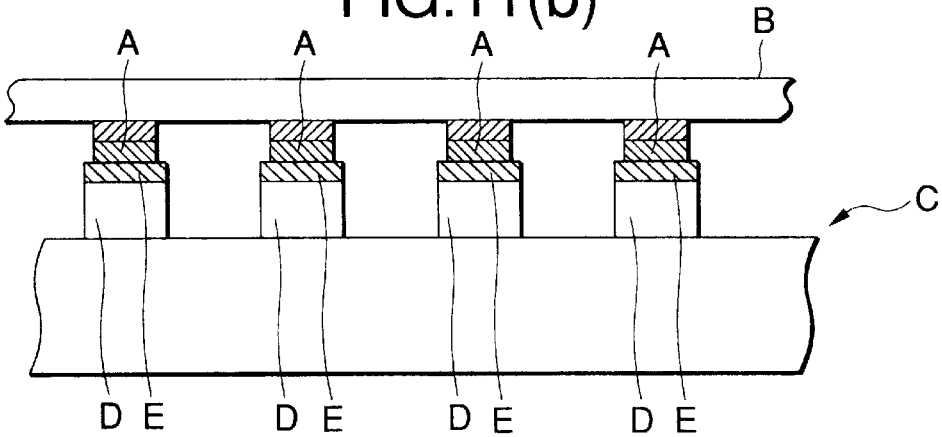
Figure 11C:
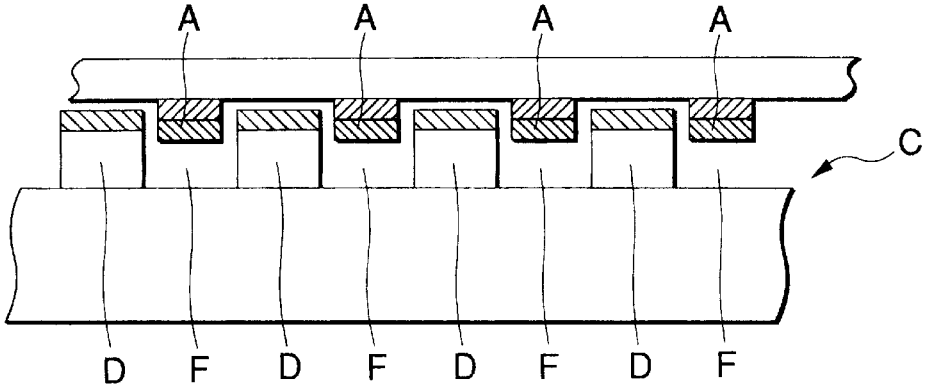

The rounded projections are also used for the connection to the common electrode of the piezoelectric transducing elements in the embodiments mentioned above. In a case where there is no need of establishing the conductive connection, for example, in the transducer unit which requires the establishing of the conductive connections only within the piezoelectric transducer forming regions, any of flexible cables shown in FIGS. 10(*a*) to 10(*c*) may be used. In the flexible cable shown in FIG. 10(*a*), the flexible cable is embossed as intact. In the flexible cable shown in FIG. 10(*b*), the conductive layer 42 is not formed on the region of the cable where is to be embossed into the rounded projection 45, and instead of the conductive layer 42, the cover coat layer 43 is formed in this region as shown. In the flexible cable shown in FIG. 10(*c*), the base layer 41 and the conductive layer 42 are both removed from the region of the cable to be embossed, and only the cover coat layer 43 is embossed Into an rounded projection 45.

As seen from the foregoing description, there is provided an ink-jet printhead having 1) a passage unit of a multi-layered structure consisting of a nozzle plate with discharge orifices formed therein, a passage forming plate including pressure generating chambers and a reservoir, both being formed therein, and an elastic plate, 2) a transducer unit having a plural number of piezoelectric transducing elements of the longitudinal vibration mode being fastened onto a fixing plate while being arrayed thereon at fixed pitches, and 3) a flexible cable for supplying electrical signals to the piezoelectric transducing elements. The ink-jet printhead is improved such that rounded projections are provided at both ends of the flexible cable when viewed in the direction in which the piezoelectric transducing elements are arrayed, each rounded projection having such a height as to prevent the connection terminals of the flexible cable from being put into the spaces each between the adjacent piezoelectric transducing elements of the transducer unit when the flexible cable is located on surface of the transducer unit. In the ink-jet printhead, the connection terminals of the flexible cable are positioned just above the piezoelectric transducing elements of the transducer unit. Therefore, it the flexible cable is moved for the aligning the connection terminals with the piezoelectric transducing elements, the connection terminals of the flexible cable do not hit the edges of the piezoelectric transducing elements. For this reason, there is no chance that the piezoelectric transducing elements are damaged through the movement of the flexible cable.

The rounded projections of the flexible cable are forcibly pressed against the connection patterns of the fixing plate by the pressure applied at the time of soldering, when compared with a case where the flexible cable not having the rounded projections is pressed against the connection patterns. Therefore, the flexible cable is reliably soldered to the fixing plate.

We claim:

1. An ink-jet printhead, comprising:

a passage unit of a multi-layered structure including a nozzle plate with discharge orifices formed therein, a passage forming, plate including pressure generating chambers and a reservoir, and an elastic plate;

a transducer unit including a fixing plate and a plurality of piezoelectric transducing elements of the longitudinal vibration mode and fastened to said fixing plate while being arrayed thereon at fixed pitches; and a flexible cable for supplying electrical signals to said piezoelectric transducing elements, said flexible cable including rounded projections at both ends of said flexible cable when viewed in the direction in which said piezoelectric transducing elements are arrayed, each of said rounded projections having such a height as to prevent the connection terminals of said flexible cable from being inserted into the space between said adjacent piezoelectric transducing elements of said transducer unit when said flexible cable is located on a surface of said transducer unit.

2. The ink-jet printhead according to claim 1, wherein said flexible cable includes at least a base layer and a conductive layer disposed on said base layer, and regions of said base layer and said conductive layer are embossed into said rounded projections.

3. The ink-jet printhead according to claim 2, further comprising a solder layer formed on said conductive layer at each of said regions where said rounded projections are formed.

4. The ink-jet printhead according to claim 3, wherein said rounded projections are electrically continuous to the common electrode of said piezoelectric transducing elements.

5. The ink-jet printhead according to claim 2, wherein said rounded projections are electrically continuous to the common electrode of said piezoelectric transducing elements.

6. The ink-jet printhead according to claim 1, wherein said flexible cable includes at least a base layer and a conductive layer disposed on said base layer, and wherein only said conductive layer is exposed in regions of said flexible cable, said regions being embossed into said rounded projections.

7. The ink-jet printhead according to claim 6, further comprising a solder layer formed on said conductive layer at each of said regions where said rounded projections are formed.

8. The ink-jet printhead according to claim 6, wherein said rounded projections are electrically continuous to the common electrode of said piezoelectric transducing elements.

9. The ink-jet printhead according to claim 1, wherein said flexible cable includes a base layer, a conductive layer disposed on said base member, and a cover coat layer disposed on said conductive layer, each of said layers being embossed into said rounded projections.

10. The ink-jet printhead according to claim 1, wherein said flexible cable includes a base layer a conductive layer disposed on said base member, and a cover coat layer disposed on said conductive layer, said conductive layer being removed from regions of said flexible cable, said base layer and said cover coat layer both being embossed at said regions into said rounded projections.

11. The ink-jet printhead according to claim 1, wherein said flexible cable includes a base layer, a conductive layer disposed on said base member, and a cover coat layer disposed on said conductive layer, said base layer and said conductive layer are removed from regions of said flexible cable, only said cover coat layer being embossed into said rounded projections at said regions.

12. The ink-jet printhead according to claim 1, wherein said flexible cable includes at least a base layer and a conductive layer disposed on said base member, and said cover coat layer is extended over the surface of said conductive layer up to a position thereon located slightly closer to a fore end of each said piezoelectric transducing elements than a rear end thereof when said flexible cable is connected to said transducer unit.

13. An ink-jet printhead comprising:

a passage unit of a multi-layered structure including a nozzle plate with discharge orifices formed therein, a passage forming plate having pressure generating chambers and a reservoir, and an elastic plate;

a transducer unit including a fixing plate and an array of piezoelectric transducing elements of the longitudinal vibration mode fastened to said fixing plate while being arrayed thereon at fixed pitches; and a flexible cable for supplying electrical signals to said piezoelectric transducing elements and including connection terminals, wherein said transducer unit includes dummy transducing elements located on both sides of said array of piezoelectric transducing elements, and rounded projections are provided in regions on said flexible cable which face said dummy transducing elements, each of said rounded projections having such a height as to prevent the connection terminals of said flexible cable from being inserted in spaces between said adjacent piezoelectric transducing elements of said transducer unit when said flexible cable is located on a surface of said transducer unit.

14. The ink-jet printhead according to claim 13, wherein said flexible cable includes at least a base layer and a conductive layer disposed on said base member, and said base layer and said conductive layer are both embossed into said rounded projections.

15. The ink-jet printhead according to claim 14, further comprising a solder layer formed on said conductive layer of each of said regions of said flexible cable where said rounded projections are formed.

16. The ink-jet printhead according to claim 15, wherein which said rounded projections are electrically continuous to a common electrode of said piezoelectric transducing elements.

17. The ink-jet printhead according to claim 14, wherein which said rounded projections are electrically continuous to a common electrode of said piezoelectric transducing elements.

18. The ink-jet printhead according to claim 13, wherein said flexible cable includes at least a base layer and a conductive layer disposed on said base member, and wherein only said conductive layer is exposed in regions of said flexible cable, said conductive layer being embossed in said regions into said rounded projections.

19. The ink-jet printhead according to claim 18, further comprising a solder layer formed on said conductive layer of each of said regions of said flexible cable where said rounded projections are formed.

20. The ink-jet printhead according to claim 18, wherein which said rounded projections are electrically continuous to a common electrode of said piezoelectric transducing elements.

21. The ink-jet printhead according to claim 13, wherein said flexible cable includes a base layer, a conductive layer disposed on said base member, and a cover coat layer disposed on said conductive layer, said layers all being embossed into said rounded projections.

22. The ink-jet printhead according to claim 13, wherein said flexible cable includes a base layer, a conductive layer disposed on said base member, and a cover coat layer disposed on said conductive layer, said conductive layer being removed from regions of said flexible cable, said base layer and said cover coat layer both being embossed into said rounded projections at said regions.

23. The ink-jet printhead according to claim 13, wherein said flexible cable includes a base layer, a conductive layer disposed on said base member, and a cover coat layer disposed on said conductive layer, said base layer and said conductive layer being removed from regions of said flexible cable, and only said cover coat layer is embossed into said rounded projections at said regions.

24. The ink-jet printhead according to claim 13, wherein said flexible cable includes at least a base layer and a conductive layer disposed on said base member, and said cover coat layer is extended over the surface of said conductive layer up to a position thereon located slightly closer to a fore end of each said piezoelectric transducing elements than a rear end thereof when said flexible cable is connected to said transducer unit.

* * * * *

UNITED STATES PATENT AND TRADEMARK OFFICE

CERTIFICATE OF CORRRECTION

PATENT NO. : 5,992,976
DATED : November 30, 1999
INVENTOR(S) : Kimura, et al.

It is certified that error appears in the above-identified patent and that said Letters Patent is hereby corrected as shown below:

On the title page, under item [56], insert the following:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 0 | 5 | 3 | 8 | 0 | 2 | 1 | A 2 | 04-21-93 | Europe | | | | |
| | 0 | 7 | 5 | 5 | 7 | 9 | 2 | A 2 | 01-29-97 | Europe | | | | |
| | 0 | 5 | 5 | 0 | 0 | 3 | 0 | A 2 | 07-07-93 | Europe | | | | |
| | 6 | - | 3 | 2 | 0 | 7 | 2 | 6 | 11-22-94 | Japan | | | | |
| | | | | | | | | | | | | | | |

Signed and Sealed this

Twenty-first Day of March, 2000

*Attest:*

*Attesting Officer*

Q. TODD DICKINSON

*Commissioner of Patents and Trademarks*